US007639827B2

(12) United States Patent
Bächler

(10) Patent No.: US 7,639,827 B2
(45) Date of Patent: Dec. 29, 2009

(54) HEARING SYSTEM WHICH IS RESPONSIVE TO ACOUSTICAL FEEDBACK

(75) Inventor: Herbert Bächler, Meilen (CH)

(73) Assignee: Phonak AG, Stafa (CH)

( * ) Notice: Subject to any disclaimer, the term of this patent is extended or adjusted under 35 U.S.C. 154(b) by 760 days.

(21) Appl. No.: 10/676,629

(22) Filed: Oct. 1, 2003

(65) Prior Publication Data

US 2005/0074128 A1 Apr. 7, 2005

(51) Int. Cl.
*H04R 25/00* (2006.01)

(52) U.S. Cl. ..... 381/315; 381/318; 381/312

(58) Field of Classification Search ..... 381/108, 381/315, 317, 318, 329, 314, 331
See application file for complete search history.

(56) References Cited

U.S. PATENT DOCUMENTS

| | | | | |
|---|---|---|---|---|
| 4,679,240 | A * | 7/1987 | Heide | 381/321 |
| 4,955,729 | A * | 9/1990 | Marx | 381/322 |
| 5,016,280 | A * | 5/1991 | Engebretson et al. | 381/320 |
| 5,553,152 | A * | 9/1996 | Newton | 381/328 |
| 6,532,294 | B1 * | 3/2003 | Rudell | 381/315 |
| 6,748,089 | B1 * | 6/2004 | Harris et al. | 381/107 |
| 7,013,015 | B2 * | 3/2006 | Hohmann et al. | 381/318 |

FOREIGN PATENT DOCUMENTS

| | | | |
|---|---|---|---|
| DE | 3742529 | C1 | 2/1989 |
| DE | 4034096 | A1 | 1/1992 |
| DE | 10223544 | C1 | 7/2003 |
| EP | 0176116 | A2 | 4/1986 |
| EP | 1465454 | A2 | 10/2004 |
| WO | 0122777 | A1 | 3/2001 |

OTHER PUBLICATIONS

Mark Ross, Dr. Ross on Hearing Loss Acoustic Feedback Control, Hearing Loss, May/Jun. 1997, 4 pages.*
European Search Report for 1424873 dated Oct. 2, 2009.

* cited by examiner

*Primary Examiner*—Curtis Kuntz
*Assistant Examiner*—Joseph Saunders, Jr.
(74) *Attorney, Agent, or Firm*—Pearne & Gordon LLP

(57) ABSTRACT

A hearing system includes a hearing device with an input acoustical/electrical converter. The system is controllably operable in at least first and second modes. A sensing unit senses behavior of an acoustical impedance of an acoustical input of the input converter. An evaluation unit evaluates the sensed behavior over at least one predetermined behavior of the acoustical impedance. An output of the evaluation unit controls change over from the first mode to the second mode.

9 Claims, 3 Drawing Sheets

HEARING SYSTEM WHICH IS RESPONSIVE TO ACOUSTICAL FEEDBACK

Figure 1:
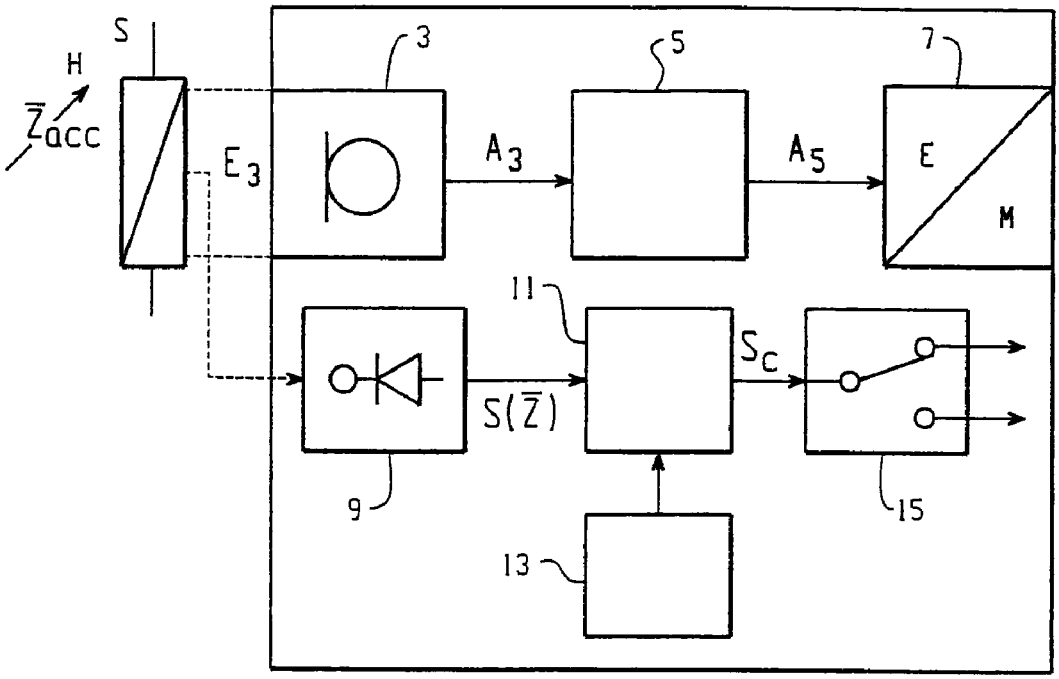

The present invention is directed to a hearing system which has at least one ear applicable hearing device with an input acoustical to electrical converter arrangement.

The present invention departs from problems which arise at hearing devices which have a manual operable member, as a toggle switch which, most generically, varies the operation status of the hearing device, be it by volume control, be it by switching from one hearing-program to another, which programs define for different signal processings between an output of the input acoustical to electrical converter arrangement and an input to the output electrical to mechanical converter arrangement. Thereby, such control operation may also include switching to a MUTE state, etc. Thus, the addressed manually operable member may control any desired operating status of the hearing device.

The problem with such manually operable members at hearing devices is, as well known in the art, that the individual carrying such device has no visual contact with the device to facilitate operation of such members and that such manually operable members must be tailored pretty small. Dependent whether the hearing device considered is an outside-the-ear hearing device, an in-the-ear hearing device or a completely in-the-canal hearing device.

Most generically, it is an object of the present invention to provide for more comfortable possibilities to control the status of operation of such hearing device.

Departing from the addressed problems at single hearing devices, this object is solved according to the present invention by a hearing system which comprises at least one ear applicable hearing device. The device has an input acoustical/electrical converter arrangement. The system is further controllably operable in one operating status and in at least one second operating status. The system has a sensing unit sensing behaviour of an acoustical impedance appearing to an acoustical input of the input converter arrangement and has an evaluation unit evaluating the sensed behaviour of at least one predetermined behaviour of the acoustical impedance, an output of the evaluation unit controlling change over from the one to the at least one second operating status.

Thus, one may select a predetermined occurrence within the acoustical surrounding presented to the acoustical input of the input converter arrangement which shall cause change over-control from one operating status of the system to a second operating status of the system.

Thereby, in a most preferred embodiment of the present invention, the addressed predetermined behaviour of the acoustical impedance may be selected to be the one which occurs when a hand is applied adjacent to and/or to the hearing device. Thereby, the hearing system is controlled in that an individual carrying the hearing device of the system applies his hand adjacent to and/or to the hearing device in a predetermined manner to cause change over of the system's operating status.

If the hearing device of the system has an output electrical/acoustical converter arrangement, the sensing unit senses stability of an acoustical/electrical feedback loop including the device applied to the individual.

As is well known in the art of hearing devices which have an electrical/acoustical output converter arrangement, such a device applied to an individual's ear is critical with respect to stability due to the acoustical feedback from the output of the output converter back to the input of the input converter.

This acoustical feedback may easily cause the feed-back loop system which includes the hearing device to become an unstably oscillating system. Thereby, oscillating results in an acoustical signal generated on a resonant frequency of the loop system. This is customarily to be avoided by all means by appropriately tailoring the amplification between the two addressed converters and/or by applying feedback compensation techniques, as e.g. shown in the DE Pat. No. 10 223 544.

These techniques do most satisfactorily prevent the ear-applied hearing device starting to oscillate in normal acoustical surroundings which are present to the hearing device at an individual's ear.

Nevertheless, whenever a predetermined acoustical input impedance, different from such impedance present in normal acoustical surrounding, is generated, the loop system may start oscillating, or at least its operating point is shifted towards instability, as perfectly known in the art of negative feedback control systems. Such shifting of the operating point of the loop system from stable point towards an unstable point may be sensed at the hearing device, evaluated to generate a control signal for the change over of the system's operating status.

In a most preferred embodiment the predetermined behaviour of the acoustical impedance is one at which the loop systems, unstable, oscillate. Thereby, the sensing unit and the evaluation unit are both realised by the acoustical/electrical feedback loop system including the hearing device and the acoustical impedance: Whenever the loop system starts oscillating and generates the respective acoustical signal sensing and evaluating has revealed, that the selected predetermined behaviour of acoustical impedance for change over control is present. As soon as the predetermined acoustical impedance causing loop-oscillation is removed and normal acoustical surrounding impedance is re-established, the loop system returns to stable behaviour.

Thereby, it is not absolutely necessary to select a predetermined acoustical impedance behaviour, so that the overall system becomes definitely unstable. It may suffice to change the acoustical feedback in a clearly detectable manner, thereby controlling operational status change over before the loop system becomes definitely unstable. The acoustical feedback signal appears at the electrical output side of the input converter and may be monitored with respect to starting to become unstable.

Thus exploiting stability behaviour of the feedback loop including the hearing device applied to an individual's ear is a most preferred mode of realising the present invention.

Nevertheless, a second mode of realising acoustical impedance sensing may be realised by providing, preferably at the hearing device, an acoustical source emitting a predetermined, acoustical signal towards the acoustical surrounding of the device. The reflected acoustical signal from the surrounding is dependent on acoustical impedance. Sensing such reflected acoustical signal at the output of the input converter arrangement accords to sensing behaviour of the acoustical impedance. Thereby the acoustical signal generated by such acoustical source is preferably selected at a frequency outside the frequency range of human hearing, e.g. in ultrasonic frequency range.

Such a form of realising acoustic impedance sensing may especially be applied, additionally to the above mentioned acoustical feedback sensing, if the inventively realised change over control includes turning the power of the hearing system to minimum requirement. Clearly, once the hearing device is turned off, no acoustical feedback for re-establishing power-on-status will be sensible. Thus, providing the addressed acoustical source which is not turned off when the remaining parts of the device are powered off, practically establishes a "MUTE"-status and preserves sensibility of the predetermined input impedance behaviour to control change over of the system's operating status back to full powered operation.

The addressed first and second operating status which are changed over according to the present invention, comprise in one preferred mode operating status of the hearing device itself.

Within the system according to the present invention, in a further preferred mode, the said status which are changed over comprise the status at a second hearing device and/or status of a communication link which is established between two such hearing devices. Further, in a preferred minimum configuration, the system according to the present invention comprises only one hearing device.

Further, the one or the two hearing devices of the system according to the present invention may be selected from the types of outside-the-ear hearing devices, in-the-ear hearing devices and of completely-in-the-canal hearing devices. The one or more than one hearing devices are further hearing aid devices.

The present invention is further directed to a method for manually controlling a hearing system with a hearing device which comprises applying a hand adjacent to and/or to the hearing device and sensing an acoustical input impedance change caused by said hand to control the hearing system.

Figure 2:
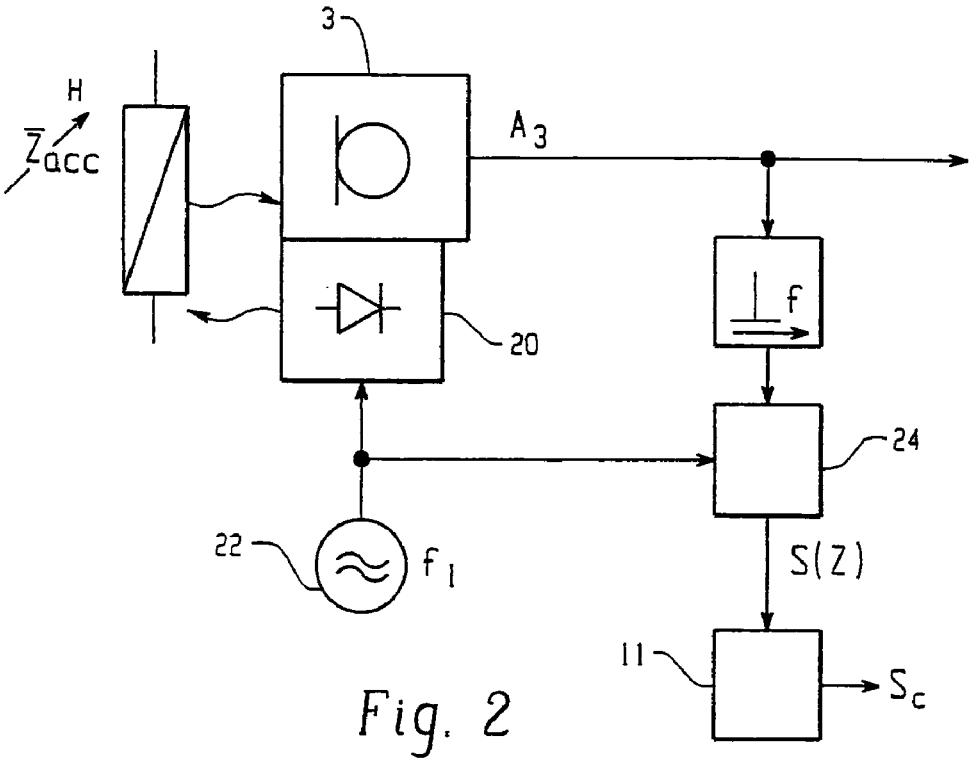
Figure 3:
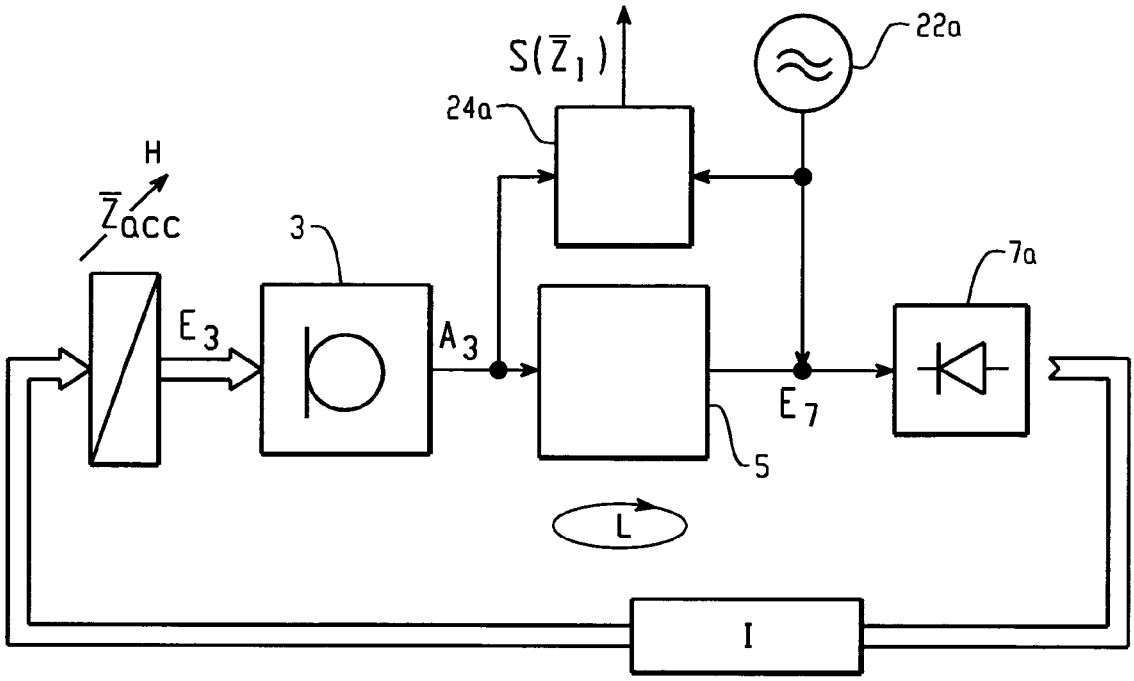
Figure 4:
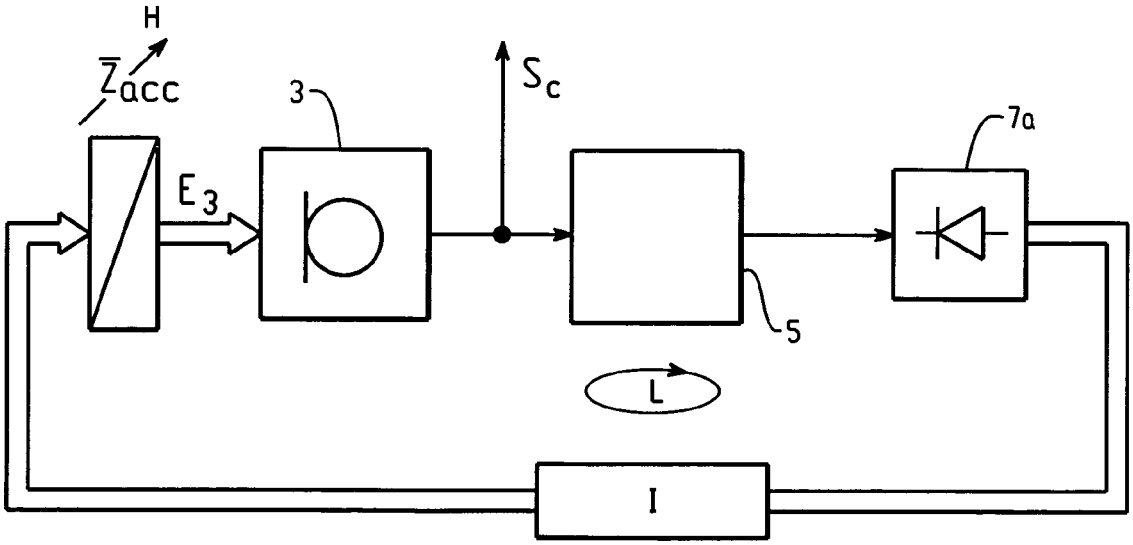
Figure 5:
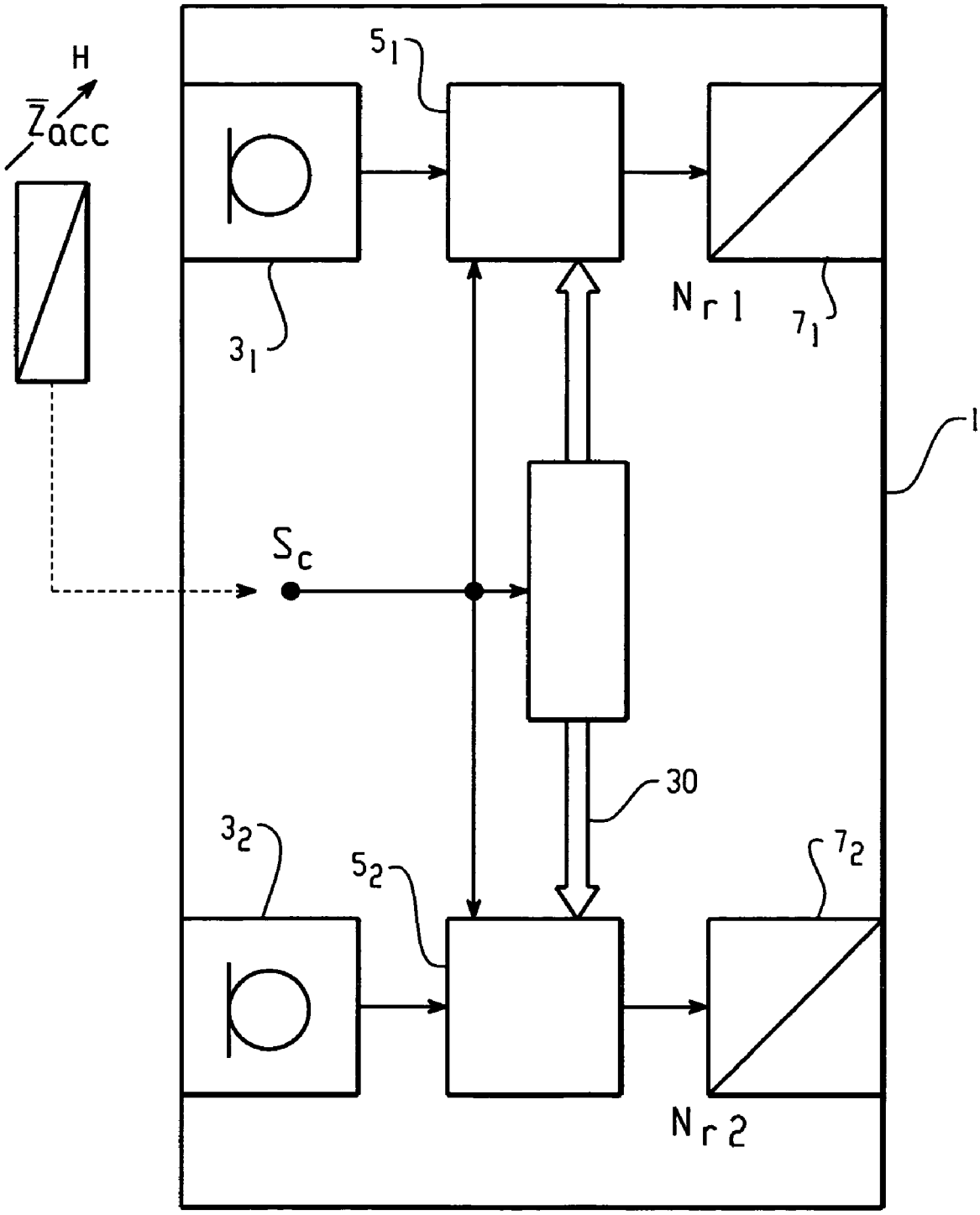

The invention shall be further exemplified with the help of figures. They show:

FIG. 1: By means of a schematical, simplified signal flow functional block representation the principal of a hearing system and of a control method according to the present invention;

FIG. 2: A part of the embodiment of FIG. 1 showing a first preferred embodiment of the invention for sensing a predetermined behaviour of acoustical impedance;

FIG. 3: still in a schematical, simplified signal flow/functional block representation a further preferred embodiment of the present invention;

FIG. 4: in representation in analogy to that of FIG. 3, a most preferred embodiment of the present invention, and FIG. 5: in a schematical/simplified signal-flow/functional block representation, a binaural hearing system according to the present invention.

In FIG. 1, there is shown the general approach according to the present invention by means of a signal flow/functional-block diagram of a hearing system 1. Such hearing system 1 comprises at least one ear-applicable hearing device. It may comprise a second ear-applicable hearing device, and then a binaural hearing system is established by providing a communicational link between the two hearing devices.

In a minimum system configuration of system 1, there is provided one hearing device with an input acoustical to electrical converter arrangement 3. The electrical output signal at an output $A_3$ of the input converter arrangement 3 is processed by an electronic signal processing unit 5, the output signal thereof, at output $A_5$, acting on an output electrical to mechanical converter arrangement 7.

The surrounding S towards which the acoustical input $E_3$ of the input converter 3 points represents to that acoustical input $E_3$ an acoustical impedance $\overline{Z}_{acc}$. The acoustical impedance $\overline{Z}_{acc}$ is a complex, frequency-dependent entity and is defined by sound pressure divided by air particle velocity. Reflection characteristic of an acoustical signal emitted at $E_3$ and reflected in the surrounding S is closely dependent on $\overline{Z}_{acc}$.

According to the present invention, most generically the behaviour of the acoustical impedance $\overline{Z}_{ac}$ is sensed as is sensed as generically shown in FIG. 1 by a sensing unit 9. The behaviour of $\overline{Z}_{acc}$ is then evaluated in an evaluation unit 11. There, in the sensed behaviour is checked whether it fulfils or does not fulfil predetermined criteria which are previously predetermined and set at evaluation unit 11 as schematically shown in FIG. 1 from a characteristics predetermining unit 13.

If the input impedance $\overline{Z}_{acc}$ fulfils the predetermined criteria preset at unit 13, then unit 11 controls change over of a first operating status of the overall system 1 into a second, different operated status as schematically shown in unit 15. The at least two operating status may e.g. include:

- powering status of hearing system 1;
- powering status of a device of the system, e.g. of the at least one hearing device;
- change of a single operating parameter as of signal amplification in unit 5 to a different level;
- change of signal processing in unit 5; etc.

If, as was mentioned above, the overall system is conceived with two hearing devices, the operating status which are controlled in dependency of the behaviour of $\overline{Z}_{acc}$ may be or may include operating status at the second hearing device and/or operating status of a communication link between the two hearing devices of a binaural hearing system 1.

Irrespective of what defines for the operating status which are controllably enabled by sensing the input impedance $\overline{Z}_{acc}$, first two techniques for sensing and evaluating the behaviour of the input impedance $\overline{Z}_{acc}$ shall be exemplified.

In FIG. 2, there is shown a first embodiment within the hearing system 1 of FIG. 1 to generate the signal $S(\overline{Z})$. Thereby, functional blocks and signals which have already been described in context with FIG. 1 are not further described and are addressed with the same reference numbers as in FIG. 1.

According to FIG. 2, there is provided an acoustical signal source 20 which emits an acoustical signal into the surrounding to which the acoustical input of input converter 3 is directed. The acoustical signal source 20 is operated preferably at a specific frequency $f_1$ by means of an oscillator 22. Preferably, the frequency $f_1$ is selected outside the range of human hearing, so that the emitted acoustical signal will not disturb the individual carrying the hearing device. The output of the oscillator 22 is operationally connected to a sensing unit 24. A second input of the sensing unit 24 is operationally connected e.g. via a band-pass filter 26 tuned to the frequency $f_1$ to the electrical output signal at output $A_3$ of the input converter arrangement 3. Possibly, a notch filter tuned to the frequency $f_1$ is provided upstream or within the signal processing unit 5 of FIG. 1.

In sensing unit 24, the electrically converted, received acoustical signal at frequency $f_1$ is related to the output signal of oscillator 22 e.g. by quotient forming, resulting in signal $S(\overline{Z})$ which is a function of the acoustical impedance $\overline{Z}_{acc}$. This signal $S(\overline{Z})$ is evaluated according to FIG. 1, by evaluation unit 11, to finally control change over of an operating status of the system 1 by output signal $S_c$.

With an eye on FIG. 1, it might absolutely be possible to use as an acoustical signal source 20 the output converter 7 conceived as an electrical to acoustical converter.

This embodiment is schematically shown in FIG. 3, Here, the oscillator **22*a* drives the output converter 7*a* conceived as an electrical to acoustical converter. The acoustical signal generated by the converter 7*a* is, as known to the skilled artisan, fed back via the surrounding I at the individual's application area and the device including acoustical impedance $\overline{Z}_{acc}$ onto the acoustical input $E_3$ of input converter 3. In analogy to the embodiment of FIG. 2, there is provided a sensing unit 24*a* which monitors or senses the behaviour of $Z_{acc}$ by evaluating an electrical signal dependent on the output signal of input converter 3 with respect to a signal dependent on the output signal of oscillator 22***a*.

The embodiments according to FIG. 2 or 3 may e.g. be realised to enable impedance behaviour sensing according to the present invention, even during times when the main circuitry of the hearing system and device has been powered off. Then, e.g. during such a "MUTE" operation status, sensing of the acoustical input impedance behaviour is kept possible, so that the hearing device or the overall hearing system may be switched back to full powered operating status. Thereby, the respective oscillators 22, 22*a* may be permanently operating but are most preferably only switched on whenever the system 1, according to FIG. 1, or the device is switched into the "MUTE" operating status.

Further, as was already addressed, most preferably there is selected a frequency of the acoustical signal generated by the respective oscillator 22 and 22*a* which is outside the hearing range of human hearing, e.g. located in the ultrasonic range.

According to the embodiment of FIG. 3, we have seen that the acoustical feedback of an output converter 7, conceived as an electrical to acoustical converter 7*a* towards and onto the acoustical input of the input converter 3 is exploited.

As perfectly known to the skilled artisan, this acoustical feedback often causes problems when tailoring the transfer characteristic between the output $A_3$ of the input converter 3 and the electrical input E7 of the output converter. This acoustical feedback—via I and $Z_{acc}$ of FIG. 3—may lead the overall feedback loop system as schematised by L in FIG. 3 to become unstable, finally to start oscillating, thereby generating an acoustical tone on the resonance frequency of the loop system. When conceiving hearing devices, thereby especially in-the-ear or completely-in-the-canal-type hearing devices, the addressed transfer characteristic is tailored with an eye on the system's stability in normal surrounding of the individual with unobstructed, open acoustical communication between such surrounding and the acoustical input of the input converter 3.

Thereby, and as e.g. described in the DE 10 223 544, considerable efforts have been spent to maintain system stability, although e.g. for higher gains by feedback compensating techniques.

In a most preferred embodiment of the present invention, it is exploited that the predetermined behaviour of input impedance $Z_{acc}$ may be selected to cause the loop system to become unstable. Thus, in a most preferred embodiment, this predetermined behaviour of the acoustical input impedance is sensed by monitoring signal behaviour at the hearing device which is representative for stability of the loop system. Leaving the established stable mode of operation may e.g. be indicated by a phase shifting at the output side of the input converter 3.

Sensing and evaluating of a predetermined behaviour of the acoustical input impedance $Z_{acc}$ is thereby most preferably achieved in that the predetermined behaviour of $Z_{acc}$ is selected so that the loop system at such impedance behaviour becomes unstable and, oscillating, generates at the acoustical output of converter 7*a* a tone. Thus, this tone indicates that the predetermined behaviour of $Z_{acc}$ has been sensed and evaluated by the loop system itself.

This most preferred approach is shown in FIG. 4. Thereby, possibly via a band-pass filter (not shown), an electric signal at the hearing device is monitored as controlling signal Sc.

As may be seen throughout the FIGS. 1 to 4, there has been introduced an arrow H representing variation of impedance $Z_{acc}$. In view of the primary object of the present invention, the predetermined behaviour of the acoustical input impedance $Z_{acc}$ which shall lead to controllably changing the operating status of the system and/or of the hearing device shall be selected so that it may be realised by the individual most comfortably. Thus there is most preferably selected a behaviour of acoustical impedance $Z_{acc}$ as it is generated whenever a hand is applied adjacent to and/or to the hearing device. By such predetermined behaviour of the acoustical input impedance, it becomes possible to control the system's operating status just by applying the hand near to or even to the hearing device. Thereby, the predetermined behaviour is selected to be uncritical of exact positioning of the hand with respect to the hearing device.

Thereby, the predetermined behaviour caused by applying the hand adjacent to and/or to the hearing device, may include at least one of a multitude of different hand applying movements, as e.g. sweeping once or more than once over the hearing device, holding the hand during a predetermined time near the hearing device, wiping with a hand over the device during a first second and afterwards maintaining the hand near by the device for another predetermined amount of time, etc. Thus, by respectively defining the hand movements which cause predetermined status switching, in fact such status controlling may be coded.

With the help of FIG. 5, there shall be exemplified which kind of operational status may be inventively controlled in system 1. Thereby, according to FIG. 5, the acoustical input impedance $Z_{acc}$ is considered to have been already sensed and evaluated as was described with the help of FIGS. 1 to 4 resulting in control signal Sc. The hearing system 1 according to FIG. 5 is a binaural hearing system, with two ear-applicable hearing devices, No. 1 and No. 2.

Communication between the hearing devices is established by a communication link 30.

The control signal Sc generated at one or possibly at both hearing devices controls at least one of hearing device No. 1, hearing device No. 2, communication link 30 as shown in FIG. 5.

By the present invention, a very comfortable mode of controllably changing the operating status of a hearing system, at least comprising a single hearing device, is established by which in the most preferred mode such control is established by the individual moving his hand just adjacent to and/or to the hearing device.

The invention claimed is:

1. A hearing system comprising:

at least one ear-applicable hearing device with an input acoustical/electrical converter arrangement, and a switching unit being switchable by an individual who controls said hearing device in a first stable operating status as desired by said individual or in at least one second stable operating status as desired by said individual, so as to adapt said hearing system by said individual to a respectively desired operating status, whereby said first and second stable operating statuses are different and are perceived by the individual as being different, said hearing system comprising a sensing unit sensing operating stability and operating instability of an acoustical feedback loop including said hearing device applied to said individual, said sensing unit controlling switch-over from said one desired to said at least one second desired operating status whenever instability of said feedback loop is sensed, said instability being willingly established by said individual at a desired moment and removed by said individual at a second desired moment so as to control said switch-over by the willingly applied instability.

2. The system of claim 1, wherein said instability of said feedback loop is established by said individual by manually applying a member adjacent to and/or to said hearing device.

3. The system of claim 2, wherein said member is a hand.

4. The system of claim 1, further comprising a second hearing device operationally connected to said at least one ear-applicable hearing device by a communication link, wherein said first and second desired operating status comprise status of at least one of said hearing devices and said communication link.

5. The system of claim 1, wherein said at least one hearing device is an outside-the-ear hearing device or an in-the-ear hearing device or a completely-in-the-canal hearing device.

6. The system of claim 1, wherein said at least one hearing device is a hearing aid device.

7. The system of claim 1, wherein said switch-over occurs during a time span between said second and said first moment.

8. A method for manually controlling a hearing system with a hearing device, to switch over from one desired operating mode of the hearing device to at least one other desired operating mode of the hearing device, comprising the steps of:

providing the hearing device, wherein the hearing device is worn by an individual;

willingly establishing, by the individual, an instable operating mode of the hearing device, wherein the instable operating mode is established by manually applying a member adjacent to and/or to said hearing device;

changing from the one desired operating mode of the hearing device to the at least one other desired. operating mode of the hearing device upon the hearing device sensing the instable operating mode; and willingly ceasing, by the individual, the instable operating mode of the hearing device after changing from the one desired operating mode of the hearing device to the at least one other desired operating mode of the hearing device.

9. A method for manually controlling a hearing system with a hearing device, to switch over from one desired operating mode of the hearing device to at least one other desired operating mode of the hearing device, comprising the steps of:

providing the hearing device, wherein the hearing device is worn by an individual;

willingly establishing, by the individual, an instable operating mode of the hearing device, wherein the instable operating mode is established by manually applying a member adjacent to and/or to said hearing device;

changing from the one desired operating mode of the hearing device to the at least one other desired operating mode of the hearing device upon the hearing device sensing the instable operating mode; and willingly ceasing, by the individual, the instable operating mode of the hearing device.

* * * * *

UNITED STATES PATENT AND TRADEMARK OFFICE

CERTIFICATE OF CORRECTION

PATENT NO. : 7,639,827 B2
APPLICATION NO. : 10/676629
DATED : December 29, 2009
INVENTOR(S) : Herbert Bachler It is certified that error appears in the above-identified patent and that said Letters Patent is hereby corrected as shown below:

In the specification, column 3, line 66, please replace " $\overline{Z}_{ac}$ " with -- $\overline{Z}_{acc}$ --.

In the specification, column 5, line 27, please replace "E7" with --$E_7$--.

In the claims, column 8, line 4, please delete the "." after the word "desired" and before the word "operating".

Signed and Sealed this

Twenty-fifth Day of May, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,639,827 B2
APPLICATION NO. : 10/676629
DATED : December 29, 2009
INVENTOR(S) : Herbert Bächler It is certified that error appears in the above-identified patent and that said Letters Patent is hereby corrected as shown below:

Title page (*) Notice

Delete "by 760 days" – and insert --by 1207 days--

Signed and Sealed this

Twenty-fourth Day of August, 2010

David J. Kappos

David J. Kappos
*Director of the United States Patent and Trademark Office*